US009682350B2

(12) United States Patent
Worley et al.

(10) Patent No.: US 9,682,350 B2
(45) Date of Patent: Jun. 20, 2017

(54) HORIZONTAL MIXER WITH CENTER-ANGLED BLADES

(75) Inventors: Mark D. Worley, Imperial, MO (US); Michael R. Mahoney, Wentzville, MO (US)

(73) Assignee: Mallinckrodt Nuclear Medicine LLC, Hazelwood, MO (US)

( * ) Notice: Subject to any disclaimer, the term of this patent is extended or adjusted under 35 U.S.C. 154(b) by 1133 days.

(21) Appl. No.: 13/808,707

(22) PCT Filed: Jul. 7, 2011

(86) PCT No.: PCT/US2011/043112

§ 371 (c)(1), (2), (4) Date: Jan. 7, 2013

(87) PCT Pub. No.: WO2012/009193

PCT Pub. Date: Jan. 19, 2012

(65) Prior Publication Data

US 2013/0114368 A1 May 9, 2013

Related U.S. Application Data

(60) Provisional application No. 61/364,436, filed on Jul. 15, 2010.

(51) Int. Cl.

| | |
|---|---|
| ***B01F 9/06*** | (2006.01) |
| ***B01F 3/12*** | (2006.01) |
| ***B01F 5/10*** | (2006.01) |
| ***B01F 9/02*** | (2006.01) |

(52) U.S. Cl.

CPC ..... *B01F 9/06* (2013.01); *B01F 3/12* (2013.01); *B01F 5/10* (2013.01); *B01F 9/025* (2013.01)

(58) Field of Classification Search

CPC ..... B01F 9/06

USPC ..... 366/57–59, 93–94, 187, 220, 225, 366/227–229

See application file for complete search history.

(56) References Cited

U.S. PATENT DOCUMENTS

| | | | | |
|---|---|---|---|---|
| 27,536 A * | 3/1860 | Embree | B01F 9/06 | 16/4 |
| 99,985 A * | 2/1870 | Wegner | B01F 9/06 | 366/226 |
| 169,498 A * | 11/1875 | Thomas | B01F 11/0014 | 366/140 |

(Continued)

FOREIGN PATENT DOCUMENTS

WO 2004103540 12/2004

*Primary Examiner* — Abbas Rashid

(74) *Attorney, Agent, or Firm* — Marsh Fischmann & Breyfogle LLP

(57) ABSTRACT

A horizontal mixer (50) is disclosed. Multiple blades (92) are affixed to and rotate with a tumbler (80) of the mixer (50). These blades (92) extend within an interior mixing chamber (90) and are center-angled so as to promote a desirable mixing action within this chamber (90) (e.g. so as to fold a slurry within the chamber (90) onto itself). One characterization is that the blades (92) are oriented so as to direct a flow toward a common outlet region (78) within the tumbler (80) throughout at least a certain rotational angle. The mixer (50) is particularly suited for realizing a desirable homogeneity of particles within a slurry from which radioisotopes may be produced.

35 Claims, 8 Drawing Sheets

(56) References Cited

U.S. PATENT DOCUMENTS 215,562 A * 5/1879 Blythe ..... B01F 9/06 366/228
424,335 A * 3/1890 McDill ..... B01F 9/06 366/225
902,718 A * 11/1908 Day ..... D06F 37/04 366/228
978,693 A * 12/1910 Capron ..... B03B 5/56 209/452
1,093,723 A 4/1914 Owens
2,077,088 A * 4/1937 Anderson ..... B01F 9/06 366/226
2,869,837 A * 1/1959 Pickin ..... B01F 9/0007 366/228
3,321,186 A * 5/1967 Lodige ..... B01F 9/06 23/313 FB
3,502,304 A * 3/1970 Pfrengle ..... B01F 9/0007 264/109
3,544,077 A * 12/1970 Van Elten ..... B01F 9/0007 366/187
4,395,129 A * 7/1983 Musil ..... E01C 19/1036 366/228
4,403,865 A * 9/1983 Fejmert ..... B01F 9/0007 366/228
4,533,053 A * 8/1985 Kenny ..... B03C 1/12 209/221
4,533,054 A * 8/1985 Sommer, Jr. ..... B03B 9/06 209/687
4,543,180 A * 9/1985 Riker ..... B03B 5/42 209/11
4,664,527 A * 5/1987 Schuler ..... B01F 9/0009 366/141
4,797,004 A * 1/1989 Buschbom ..... B01F 9/0009 366/186
4,813,154 A * 3/1989 Ronning ..... A23N 17/007 34/137
4,836,918 A * 6/1989 Szikriszt ..... B01F 9/06 210/151
4,971,449 A * 11/1990 Hendren ..... B01F 9/06 366/105
4,973,167 A 11/1990 Zmarlicki
5,087,326 A * 2/1992 Jones ..... B01F 9/06 162/244
5,380,085 A * 1/1995 Milek ..... B28C 5/2072 366/193
5,389,399 A * 2/1995 Bazin ..... A01C 1/06 118/19
6,350,052 B1 * 2/2002 Storz ..... B28C 5/1893 366/228
2008/0213742 A1 * 9/2008 Asgari ..... B01F 9/0016 435/1.1
2009/0073798 A1 3/2009 Wallgren

* cited by examiner

HORIZONTAL MIXER WITH CENTER-ANGLED BLADES

CROSS REFERENCE TO RELATED APPLICATIONS

This patent application is a U.S. National Stage of PCT/US2011/043112, filed 7 Jul. 2011, which is a non-provisional application of and claims the benefit of U.S. Provisional Application No. 61/364,436 filed Jul. 15, 2010. Priority is claimed to each patent application set forth in this Cross-Reference to Related Applications section, and the entire disclosure of each such patent application is incorporated herein in its entirety.

FIELD OF THE INVENTION

The present invention generally relates to the field of mixers and, more particularly, to how blades may be incorporated by a mixer to enhance mixing.

BACKGROUND

Various types of mixers exist and for a variety applications. One type of mixer uses a vertically-oriented shaft with blades attached thereto, and which is disposed in an appropriate housing. The shaft and blades rotate relative to the housing. In the case where these types of mixers are used for producing abrasive slurries from which radioisotopes are formed, the abrasive particles tend to chip the blades such that these blade chips become part of the abrasive slurry. Moreover, centrifugal forces create a distribution of particles within the slurry—particles are distributed in the slurry based upon their respective weights progressing away from the rotating shaft (i.e., heavier particles will be directed further away from the vertically oriented, rotating shaft than lighter particles). Although this may be acceptable for certain applications, other applications could benefit for a more homogenous distribution of particles within the slurry.

SUMMARY

A first aspect of the present invention is embodied by a horizontal mixer. This mixer includes a container or tumbler that is able to rotate about an at least substantially horizontally disposed rotational axis, an inner sidewall that is disposed about this rotational axis (e.g., extends a full 360° about this rotational axis), and a mixing chamber that is at least partially defined by this inner sidewall. Multiple blades or fins extend from the inner sidewall of the container and in the direction of an interior of the mixing chamber (e.g., defining protrusions on the inner sidewall). These blades are oriented to direct fluid toward an outlet from the mixing chamber for at least a certain rotational angle and during rotation of the container in a first rotational direction about its rotational axis.

A second aspect of the present invention is embodied by a horizontal mixer. This mixer includes a container or tumbler having first and second container/tumbler ends that are spaced along an at least substantially horizontally disposed rotational axis of the container. An inner sidewall of the container is disposed about its rotational axis and extends between the first and second container ends. The first and second container ends, along with the inner sidewall, at least partially define a mixing chamber for the container. An outlet accommodates a discharge from the mixing chamber.

A plurality of first blades or fins and a plurality of second blades or fins each extend from the inner sidewall of the container and in the direction of an interior of the mixing chamber (e.g., defining protrusions on the inner sidewall) in the case of the second aspect. Each of the first and second blades has a first blade end and a second blade end. Each first blade extends from its corresponding first blade end toward its corresponding second blade end at least generally in the direction of the second container end (e.g., the second blade end of each first blade may be characterized as being between its corresponding first blade end and the second container end relative to a dimension in which the rotational axis of the container extends (hereafter a longitudinal dimension)). Each second blade extends from its corresponding first blade end toward its corresponding second blade end at least generally in the direction of the first container end (e.g., the second blade end of each second blade may be characterized as being between its corresponding first blade end and the first container end relative to the longitudinal dimension). In the case of the second aspect, the first blade end of each first and second blade leads its corresponding second blade end in a first rotational direction for the container.

A number of feature refinements and additional features are separately applicable to each of the first and second aspects of the present invention. These feature refinements and additional features may be used individually or in any combination. As such, each of the following features that will be discussed may be, but are not required to be, used with any other feature or combination of features of the first and/or second aspects. The following discussion is separately applicable to each of the first and second aspects, up to the start of the discussion of a third aspect of the present invention. Initially, each feature of the first aspect may be used by the second aspect alone or in any combination, and vice versa.

Each blade used by the horizontal mixer may be of any appropriate size, shape, configuration, and/or type. For instance, each blade may be in the form of a plate having a pair of oppositely disposed flat or planar surfaces. Although each blade may be of an identical configuration and size, such may not be the case in all instances. Any appropriate number of blades may be utilized by the horizontal mixer, and the blades may be integrated with the container in any appropriate manner (e.g., by being separately attached to the inner sidewall of the container; by being integrally formed with the container such that there is no joint of any kind between the inner sidewall of the container and each of its blades).

The blades may be arranged on the inner sidewall of the container to promote a desired mixing action of contents within the mixing chamber of the horizontal mixer. The blades may extend along the inner sidewall of the container in non-parallel relation to the rotational axis of the horizontal mixer. The blades may be oriented so as to be "center angled." One embodiment has the length dimension of each blade (the length dimension of a blade coinciding with the direction that the blade extends along the inner sidewall of the container) proceeding in a direction so as to direct fluid toward the outlet from the mixing chamber throughout at least a certain rotational angle of the container proceeding in the first rotational direction. Each blade may be oriented relative to the inner sidewall so as to bias a fluid flow toward the outlet throughout at least a certain rotational angle of the container proceeding in the first rotational direction.

The blade orientation may be described in relation to the location of its two blade ends—the spacing between which corresponds with the length dimension of the blade. The two blade ends of each blade, at its intersection with the inner sidewall of the container may be disposed at different elevations relative to a horizontal reference plane that is disposed below the horizontal mixer. Although the elevation of this intersection could continually change between these two blades ends in this instance, such may not always be the case.

The two ends of each blade may be disposed on different reference axes that are each parallel to the rotational axis of the tumbler. Consider the case where each blade has a first blade end and an oppositely disposed second blade end. The first blade end of a given blade may be disposed on a first reference axis and the second blade end may be disposed on a different second reference axis, where each of the first and second reference axes are parallel to the rotational axis of the horizontal mixer. Stated another way, the first and second blade ends of each blade may be characterized as being located at different angular positions, measured relative to the rotational axis of the tumbler.

The end of each blade that is adjacent-most to an end of the horizontal mixer may lead its opposite end in a first rotational direction for the container. Consider the case where a first blade end of a blade is disposed between a first container end of the horizontal mixer and its oppositely disposed second blade end proceeding in the longitudinal dimension. During rotation of the container in a first rotational direction, the first blade end of the noted blade will pass the 6 o'clock position before its second blade end passes this same 6 o'clock position when the first blade end leads the second blade end in the first rotational direction. The second blade end could also be characterized as lagging its corresponding first blade end during rotation of the container in this same first rotational direction.

Each of the first and second aspects may utilize both a plurality of first blades and a plurality of second blades, where each of the first and second blades has a first blade end and a second blade end, where each first blade extends from its corresponding first blade end toward its corresponding second blade end at least generally in the direction of a second container end of the container for the horizontal mixer (e.g., the second blade end of each first blade may be characterized as being between its corresponding first blade end and the second container end relative to or proceeding along the rotational axis of the container), where each second blade extends from its corresponding first blade end toward its corresponding second blade end at least generally in the direction of a first container end of the container for the horizontal mixer (e.g., the second blade end of each second blade may be characterized as being between its corresponding first blade end and the first container end relative to or proceeding along the rotational axis of the container), and where the first blade end of each first and second blade leads its corresponding second blade end in a first rotational direction for the container. The following discussion, up to the start of the discussion of a third aspect of the present invention, pertains to such a configuration.

The first blade end of each first blade may be located at or at least generally proximate to the first container end, while the first blade end of each second blade may be located at or at least generally proximate to the second container end (where the first and second container ends again are spaced along the rotational axis of the horizontal mixer). The horizontal mixer may be characterized as including a plurality of blade pairs, where each blade pair includes one first blade and one second blade. The first and second blades of each blade pair may be oriented as the mirror image of each other. Each blade pair may define at least generally V-shaped configuration. Each blade pair may collectively define a concave profile relative to the first rotational direction. A space between the blades of each blade pair may define the trailing portion of the blade pair when the container is rotated about its rotational axis in the first rotational direction.

The position of the plurality of second blades could be staggered in relation to the position of the plurality of first blades. The first blade end of each first blade could be disposed at a different angular position (relative to the rotational axis of the container) than the first blade end of each second blade. Consider the case where there are 6 first blades and 6 second blades. The first blade ends of the 6 first blades could be disposed at the 1, 3, 5, 7, 9, and 11 o'clock positions in a first static position for the container, while the first ends of the 6 second blades could be disposed at the 2, 4, 6, 8, 10, and 12 o'clock positions in this same first static position, or vice versa.

The length dimension of the various first and second blades may be disposed at a common angle relative to a reference axis that intersects their corresponding second blade end and that is parallel to the rotational axis of the horizontal mixer. Stated another way, the same angle may be defined between the length of each blade and a reference axis that intersects its second blade end and that is parallel to the rotational axis. Another option would be for the length dimension of the plurality of first blades to be disposed at a common first angle relative to a reference axis that intersects their corresponding second blade end and that is parallel to the rotational axis of the horizontal mixer, for the length dimension of the plurality of second blades to be disposed at a common second angle relative to a reference axis that intersects their corresponding second blade end and that is parallel to the rotational axis of the horizontal mixer, and for the magnitudes of the first and second angles to be different.

The plurality of first blades may coincide with or define a first longitudinal segment of the horizontal mixer, the plurality of second blades may coincide with or define a third longitudinal segment of the horizontal mixer, and a second longitudinal segment of the horizontal mixer may be located between the first and third longitudinal segments. The longitudinal dimension may coincide with the rotational axis of the horizontal mixer. In any case, the second longitudinal segment may include the outlet. One embodiment has the first, second, and third longitudinal segments being disposed in non-overlapping relation. Another embodiment has the first, second, and third longitudinal segments being disposed in end-to-end relation and in the noted order.

The outlet from the mixing chamber may be located between the second ends of the various first blades and the second ends of the various second blades. The second ends of the various first blades may be spaced from the second ends of the various second blades in a direction coinciding with the rotational axis of the horizontal mixer, and the outlet from the mixing chamber may be located within this space. In one embodiment, the outlet from the mixing chamber may be at least substantially mid-way between the first and second container ends of the horizontal mixer.

The first container end may include an aperture, and the horizontal mixer may further include an outlet conduit that extends through this aperture and into the mixing chamber. The aperture may be significantly larger than the outer diameter of the portion of the outlet conduit that passes therethrough. A first outlet conduit section may extend through this aperture and at least generally in the direction of the oppositely disposed second container end (e.g., at least generally parallel with the rotational axis of the horizontal mixer), and a second outlet conduit section may extend from the first outlet conduit section in at least a generally downward direction and may terminate prior to reaching the inner sidewall of the container to define the outlet from the mixing chamber. This second outlet conduit section may be disposed within the space between the second blade ends of the various first blades and the second blade ends of the various second blades. Other outlet configurations may be appropriate. It should be noted that the fluid level within the mixing chamber may be controlled such fluid does not spill out of the noted aperture in the first container end (e.g., the fluid level may be below the rotational axis of the container, including significantly below).

A third aspect of the present invention is directed to a fluid system that utilizes a horizontal mixer, at least one feed source, and a slurry target. The horizontal mixer includes a container that may rotate about an at least substantially horizontally disposed axis ("rotational axis"). An inner sidewall of this container is disposed about the rotational axis and at least partially defines a mixing chamber for the horizontal mixer. The horizontal mixer further includes a plurality of blades that extend from and rotate with the inner sidewall (e.g., such that the blades extend within the mixing chamber). An outlet exists for the mixing chamber. Fluid and a plurality of particles may be directed into the horizontal mixer in any appropriate manner, and a discharge from the outlet of the horizontal mixer may be in the form of a slurry that is directed to the slurry target.

A number of feature refinements and additional features are applicable to the third aspect of the present invention. These feature refinements and additional features may be used individually or in any combination. As such, each of the following features that will be discussed may be, but are not required to be, used with any other feature or combination of features of the third aspect. The following discussion is applicable to the third aspect, up to the start of the discussion of a fourth aspect of the present invention. Initially, the horizontal mixer discussed above in relation to the first aspect may be used by this third aspect. The horizontal mixer discussed above in relation to the second aspect may be used by this third aspect as well. Any of the features of the horizontal mixer discussed above in relation to the first and/or second aspects may be utilized by the horizontal mixer that is utilized by this third aspect, individually or in any combination.

The fluid system may utilize two or more separate feed sources. One feed source may contain a supply of particles, while another feed source may contain a supply of an appropriate fluid (e.g., one or more appropriate liquids). Each feed source could provide a direct flow or a separate stream to the horizontal mixer. Alternatively, the output from two or more feed sources could be combined before actually being directed into the horizontal mixer (e.g., into a common inlet manifold or header). A given feed source could contain both particles and fluid for a slurry.

Any appropriate type of particulates may be introduced into the horizontal mixer and in any appropriate manner. In one embodiment, aluminum oxide (alumina) is directed into the horizontal mixer, and alumina slurry is removed from the horizontal mixer and is ultimately directed into a glass column, vial, container, or the like for use in the process of column chromatography. Solvents and other chemicals may be added to the column of alumina to initiate a chemical process that produces radioisotopes. The resulting radioisotopes may be used for any appropriate application, such as for medical diagnosis, medical treatment, or medical research. As such, the fluid system of the third aspect may be characterized as one that provides slurry from which isotopes may be produced, including radioisotopes. If the column of alumina contains particles that are unevenly distributed, the chemical process that produces the radioisotope may be skewed. The horizontal mixer described in relation to the first and second aspects may provide a desired degree of homogeneity for slurry from which isotopes may be produced.

The slurry target may be of any appropriate type. One embodiment has the slurry target in the form of a dispenser that is used to provide slurry to an end-use container (e.g., a glass column, vial, or other container). Another embodiment has the slurry target being in the form of an end-use container. Although the slurry may be of any appropriate type and used for any appropriate application, in one embodiment the slurry contains abrasive particulate matter for nuclear medicine applications.

A fourth aspect of the present invention is embodied by a method of providing slurry. A mixer is used to provide the slurry, and includes first and second mixer ends that are spaced along a first axis that is at least substantially horizontally disposed. A plurality of particles and fluid may be directed into the mixer. The mixer may be rotated about the first axis. A first flow is directed from the first mixer end toward a first location within the mixer that is located between the first and second mixer ends. Similarly, a second flow is directed from the second mixer and toward this same first location. The slurry is withdrawn from the first location of the mixer, and includes a distribution of the particles in the fluid.

A number of feature refinements and additional features are applicable to the fourth aspect of the present invention. These feature refinements and additional features may be used individually or in any combination. As such, each of the following features that will be discussed may be, but are not required to be, used with any other feature or combination of features of the fourth aspect. The following discussion is applicable to at least the fourth aspect. Initially, the horizontal mixer discussed above in relation to the first aspect may be used by this fourth aspect to mix the particles and fluid to define the slurry. The horizontal mixer discussed above in relation to the second aspect may be used by this fourth aspect as well to mix the particles and fluid to define the slurry. Any of the features of the horizontal mixer discussed above in relation to the first and/or second aspects may be utilized by the horizontal mixer that is part of this fourth aspect, individually or in any combination.

A first stream of particles may be directed into the mixer. A separate, second stream of fluid may be directed into the mixer. Another option is for a first stream of particles and a second stream of fluid to be combined before being introduced into the mixer. A single stream of particles and fluid could be directed into the mixer as well. In one embodiment, the particles are in the form of alumina.

Fluid may be directed to the first location using gravitational forces. For instance, the orientation of the blades discussed above in relation to the first, second, and third aspects may be used to induce a gravitational flow along the blades in the direction of the first location through at least a certain rotational angle of the mixer. The induced flow toward the first location within the mixer may be the result of exerting a lifting force on a portion of the contents within the mixer and simultaneously inducing a pressure gradient on this portion of the contents. For instance, a blade on an inner sidewall of the mixer may be rotated into the fluid, and during continued rotation may exert both a lifting force on a portion of the fluid (and any particles therein) and may direct this fluid portion toward the first location.

Slurry may be withdrawn from the horizontal mixture (e.g., via pump, such as a peristaltic pump) and provided to a dispenser of any appropriate type. Slurry provided to the dispenser may be directed to multiple locations. One is a container (e.g., a glass column, vial, or the like). Another is a recirculation loop back to the horizontal mixer. In one embodiment, slurry enters the dispenser and is provided to a container. In one embodiment, at least part of the slurry that is directed into the dispenser is recirculated back to the horizontal mixer. Slurry that is delivered to a container may be used to produce isotopes, and including radioisotopes.

A number of feature refinements and additional features are separately applicable to each of above-noted first, second, third, and fourth aspects of the present invention. These feature refinements and additional features may be used individually or in any combination in relation to each of the above-noted first, second, third, and fourth. Any feature of any other various aspects of the present invention that is intended to be limited to a "singular" context or the like will be clearly set forth herein by terms such as "only," "single," "limited to," or the like. Merely introducing a feature in accordance with commonly accepted antecedent basis practice does not limit the corresponding feature to the singular (e.g., indicating that a fluid system includes "a pump" alone does not mean that the fluid system includes only a single pump). Moreover, any failure to use phrases such as "at least one" also does not limit the corresponding feature to the singular (e.g., indicating that a fluid system includes "a pump" alone does not mean that the fluid system includes only a single pump). Use of the phrase "at least generally" or the like in relation to a particular feature encompasses the corresponding characteristic and insubstantial variations thereof (e.g., indicating that a mixer rotates about an axis that is at least generally horizontally disposed encompasses the mixer rotating about a horizontal axis). Finally, a reference of a feature in conjunction with the phrase "in one embodiment" does not limit the use of the feature to a single embodiment.

DETAILED DESCRIPTION

Figure 1:
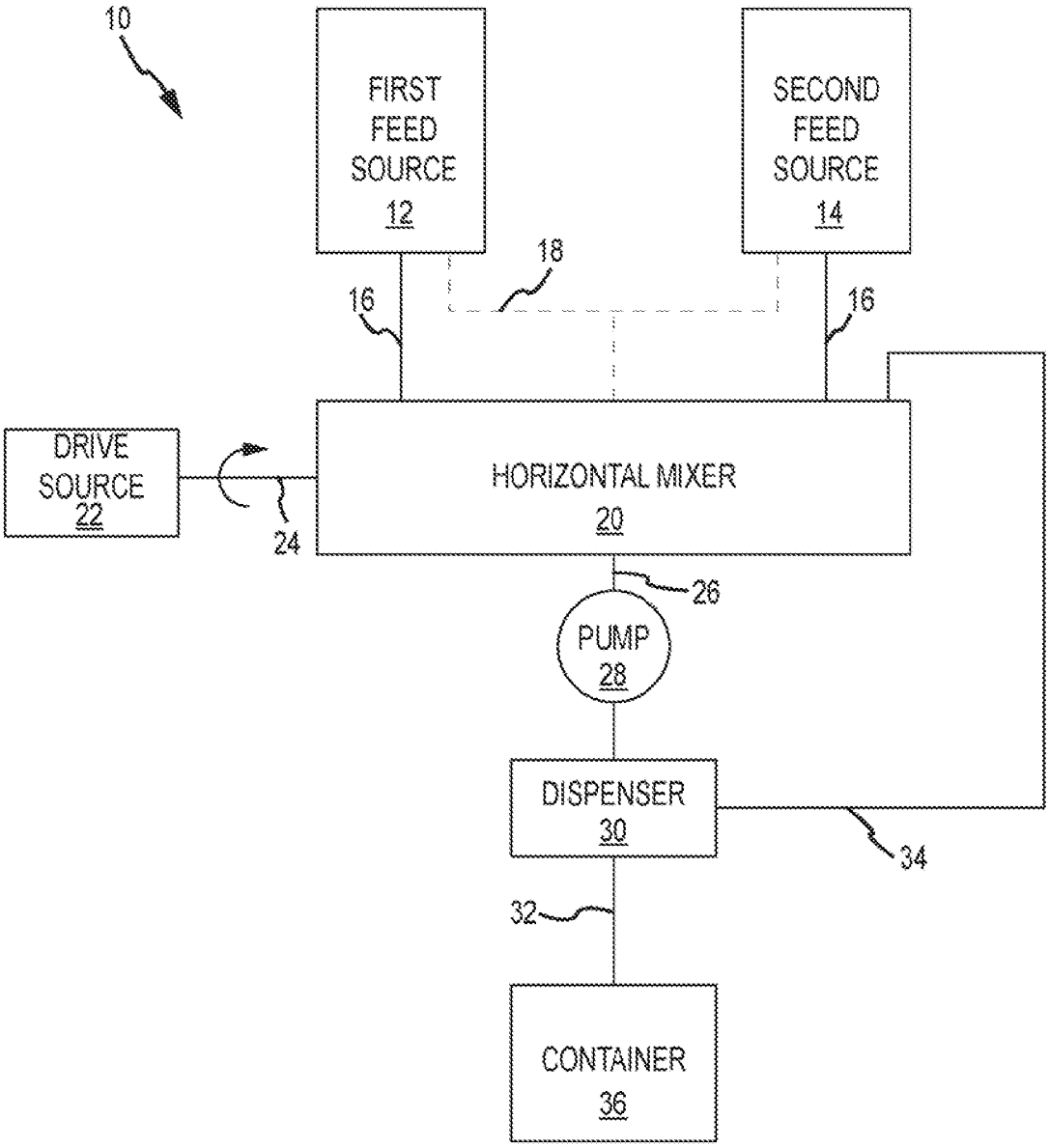
FIG. 1 is a schematic of a fluid system that utilizes a horizontal mixer.

FIG. 1 is a schematic representation of one embodiment of a fluid system 10 that may be used to provide a slurry to a desired slurry target. As such, the fluid system 10 could also be referred to as a slurry system 10. The fluid system 10 utilizes as least one feed source to direct slurry components into a horizontal mixer 20. In the illustrated embodiment, a first feed source 12 is fluidly connected with the horizontal mixer 20 and contains a first slurry component (e.g., particles or particulates). A second feed source 14 is also fluidly connected with the horizontal mixer 20 and contains a second slurry component (e.g., a fluid). A single feed source could be used to provide the slurry components to the horizontal mixer 20. Three or more feed sources could also be used to provide different slurry components to the horizontal mixer 20.

One or more feed sources could have a direct fluid connection with the horizontal mixer 20, two or more feed sources could have their outputs merged or combined prior to entering the horizontal mixer 20, or any combination thereof. A separate input or inlet line 16 may extend between the horizontal mixer 20 and each of the first feed source 12 and the second feed source 14 (indicated by the solid lines in FIG. 1). The output from the first feed source 12 and second feed source 14 alternatively may be directed into a common input or inlet line 18 (where their respective outputs are merged or combined, and indicated by the dashed line in FIG. 1) that extends to the horizontal mixer 20. The common input line 18 may include a common header or intake manifold that receives a flow, output, or discharge from each of the first feed source 12 and second feed source 14, and directs or introduces the same into the horizontal mixer 20 in the form of a single input or stream.

The mixer 20 used by the fluid system 10 is of the horizontal type—a mixer that rotates about an at least substantially horizontally disposed rotational axis. The horizontal mixer 20 is rotatably driven by a drive source 22. The output from the drive source 22 rotates a drive shaft 24, which in turn is appropriately interconnected with the horizontal mixer 20 to rotate the same. The drive source 22 may be of any appropriate size, shape, configuration, and/or type. Multiple drive sources could also be used to rotate the horizontal mixer 20.

Slurry from the horizontal mixer 20 may be withdrawn through an output or outline line 26. A pump 28 of any appropriate type (e.g., peristaltic) may be used to withdraw slurry from the horizontal mixer 20, to transfer the slurry to a desired slurry target, or both. In the illustrated embodiment, slurry from the horizontal mixer 20 is directed into a dispenser 30 via the output line 26. The dispenser 30 may be of any appropriate size, shape, configuration, and/or type. There are two available flowpaths out of the dispenser 30. The dispenser 30 may direct slurry into a container 36 (e.g., a column, vial, or the like) via an output or outlet line 32. The dispenser 30 may also direct slurry back to the horizontal mixer 20 via a recirculation line 34. The dispenser 30 may be configured to direct a certain quantity of slurry into the container 36, while the remainder of the slurry being directed into the dispenser 30 may be recirculated back to the horizontal mixer 20 by the recirculation line 34. It should be appreciated that one or more valves, controllers, or the like (not shown) may be utilized by the fluid system 10 to control one or more aspects of its operation.

One embodiment of a horizontal mixer that may be used by the fluid system 10 of FIG. 1 is illustrated in FIGS. 2-7 and is identified by reference numeral 50. The horizontal mixer 50 may be used for any appropriate application, including medical applications that utilize a slurry (e.g., for the production of radioisotopes).

The horizontal mixer 50 includes a frame 52 that supports a tumbler, container, or mixer body 80, which in turn may be rotated relative to the frame 52 by a drive source 62 about an at least substantially horizontally disposed rotational axis 110. The frame 52 includes a bed 54. Multiple supports 56*a-c* extend from the bed 54 and may be integrated with the bed 54 in any appropriate manner. The drive source 62 may be supported by and mounted to the support 56*a* in any appropriate manner. The tumbler 80 may be located between the supports 56*b*, 56*c*. Further in this regard, a drive roller 58 extends between the supports 56*b*, 56*c*. Moreover, one idler roller 60 is rotatably supported by the support 56*b*, and another axially aligned idler roller 60 is rotatably supported by the support 56*c*. The rollers 58, 60 engage and support an exterior surface 84*b* of the tumbler 80 (e.g., the rollers 58, 60 collectively define a cradle that supports the tumbler 80). The pair of idler rollers 60 could be replaced by a single idler roller that extends between the supports 56*b*, 56*c* (not shown). The single drive roller 58 could be replaced by a pair of drive rollers (not shown, but where one such drive roller is rotatably supported by the support 56*b* and where another such drive roller is rotatably supported by the support 56*c*, for instance in the manner of the idler rollers 60).

In the illustrated embodiment, the drive roller 58 is rotated by the drive source 62. In this regard, a drive gear 64 is disposed between the supports 56*a*, 56*b*, and is rotatably driven by the output from the drive source 62. A driven gear 66 is also located between the supports 56*a*, 56*b*, and is interconnected with the drive gear 64 by a drive belt 68. Rotation of the drive gear 64 is thereby transmitted to the driven gear 66 by the drive belt 68. The driven gear 66 is appropriately interconnected with the drive roller 58. Rotation of the driven gear 66 thereby rotates the drive roller 58 (e.g., the driven gear 66 and the drive roller 58 rotate together and in the same direction).

The driver roller 58 is engaged with an exterior surface 84*b* of the tumbler 80 (specifically, its sidewall 82 or an outer sidewall 84*b*). Rotation of the drive roller 58 rotates (e.g., drives) the tumbler 80 about its rotational axis 110. The idler rollers 60 also engage the exterior surface 84*b* of the tumbler 80 (specifically, its outer sidewall 82). In the illustrated embodiment, the idler rollers 60 are "free spinning", such that rotation of the tumbler 80 causes the idler rollers 60 to rotate. Any appropriate way of rotating the tumbler 80 may be utilized. Any appropriate way of rotatably supporting the tumbler 80 may be utilized as well.

The tumbler 80 of the horizontal mixer 50 includes a tumbler or mixer sidewall 82 and a pair of tumbler or mixer ends 86*a*, 86*b* that are spaced along the rotational axis 110 and that collectively define a mixing chamber 90. One of the tumbler ends 86*a* (associated with the support 56*b* of the frame 52) includes an aperture or opening 88 through which an input/inlet line 70 and output/outlet line 72 may extend, and that will be discussed in more detail below. The tumbler end 86*a* could be disposed in sealing engagement with the support 56*b* (e.g., a seal that would allow the tumbler 80 to rotate relative to the support 56, and yet have a fluid-tight seal exist therebetween), or could be spaced therefrom. The tumbler end 86*b* is closed in the illustrated embodiment. The sidewall 82 may be of an at least generally cylindrical shape.

An interior surface 84*b* of the sidewall 82 (or an inner sidewall 84*b*) includes a plurality of blades or fins 92. Generally, these blades 92 are orientated relative to the rotational axis 110 of the tumbler 80 or promote a desired mixing action within the mixing chamber 90 (e.g., providing a desired level of homogeneity of particles within the slurry). This mixing action may be characterized as slurry within the tumbler 80 being folded onto itself during rotation of the tumbler 80 and by the action of the various blades 92. This mixing action may also be characterized as the blades 92 funneling or directing a flow to a common region 78 within the mixing chamber 90 through at least a certain rotational angle, where slurry may be removed from this common region 78 through the above-noted output line 72 that extends therein. The mixing action may also be characterized as the blades 92 both lifting a portion of the slurry and inducing a pressure gradient within the lifted slurry portion that directs the same toward the common region 78, again where slurry may be removed from this common region 78 through the output line 72 that extends in this common region 78. In one embodiment, the common region 78 is located at least generally mid-way between the ends 86*a*, 86*b* of the tumbler 80. Other locations may be appropriate.

Figure 2:
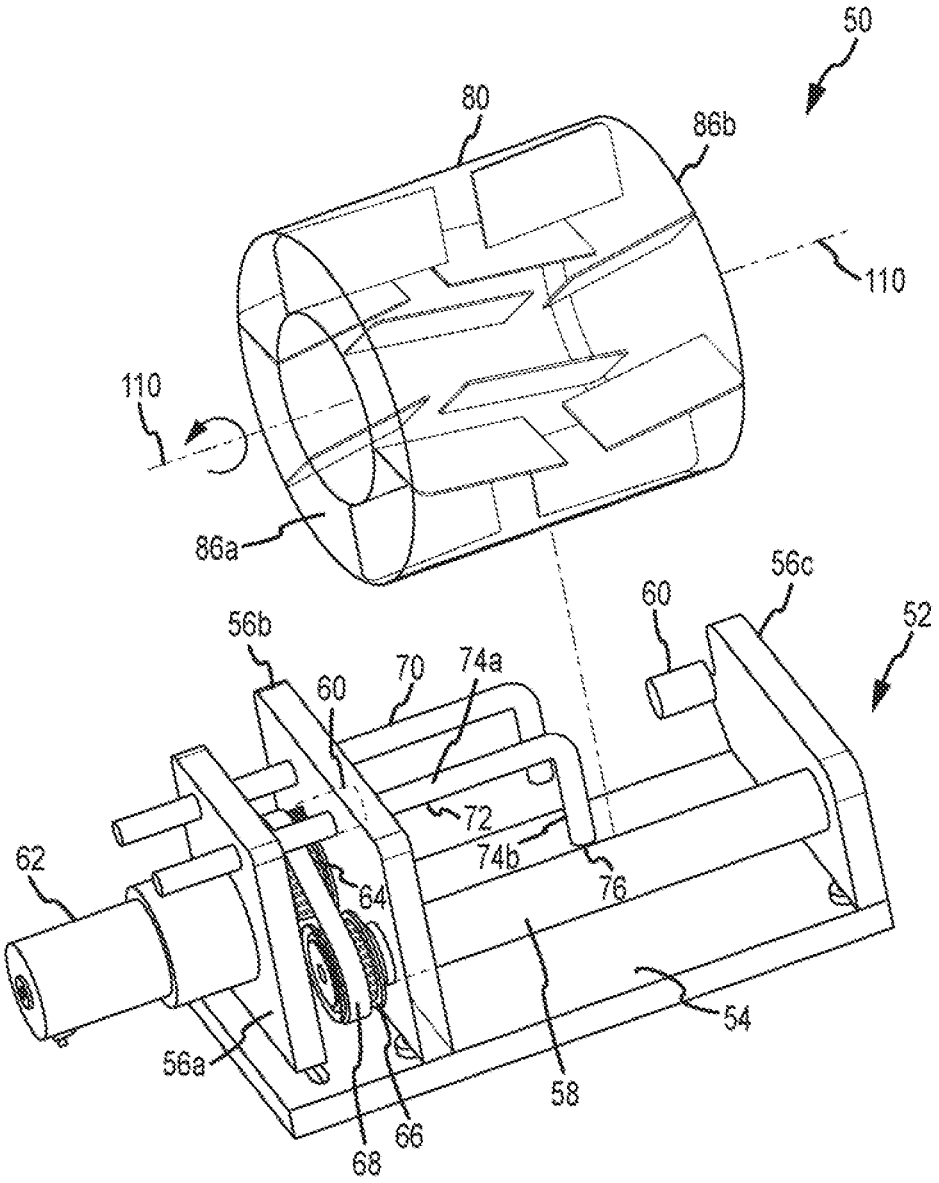
FIG. 2 is a perspective view of one embodiment of a horizontal mixer that may be used by the fluid system of FIG. 1, with the tumbler being exploded away from the frame, and with its various blades being shown in their entirety for clarity.
Figure 3:
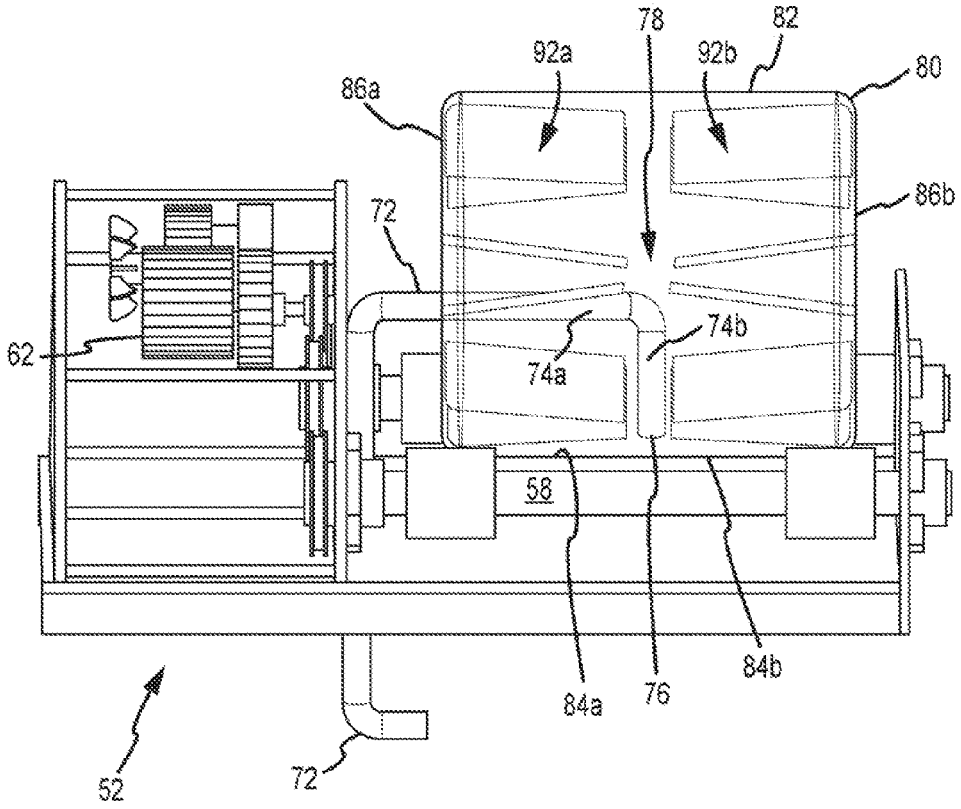
FIG. 3 is a side view of the horizontal mixer of FIG. 2, and with its various blades being shown in their entirety for clarity.
Figure 4:
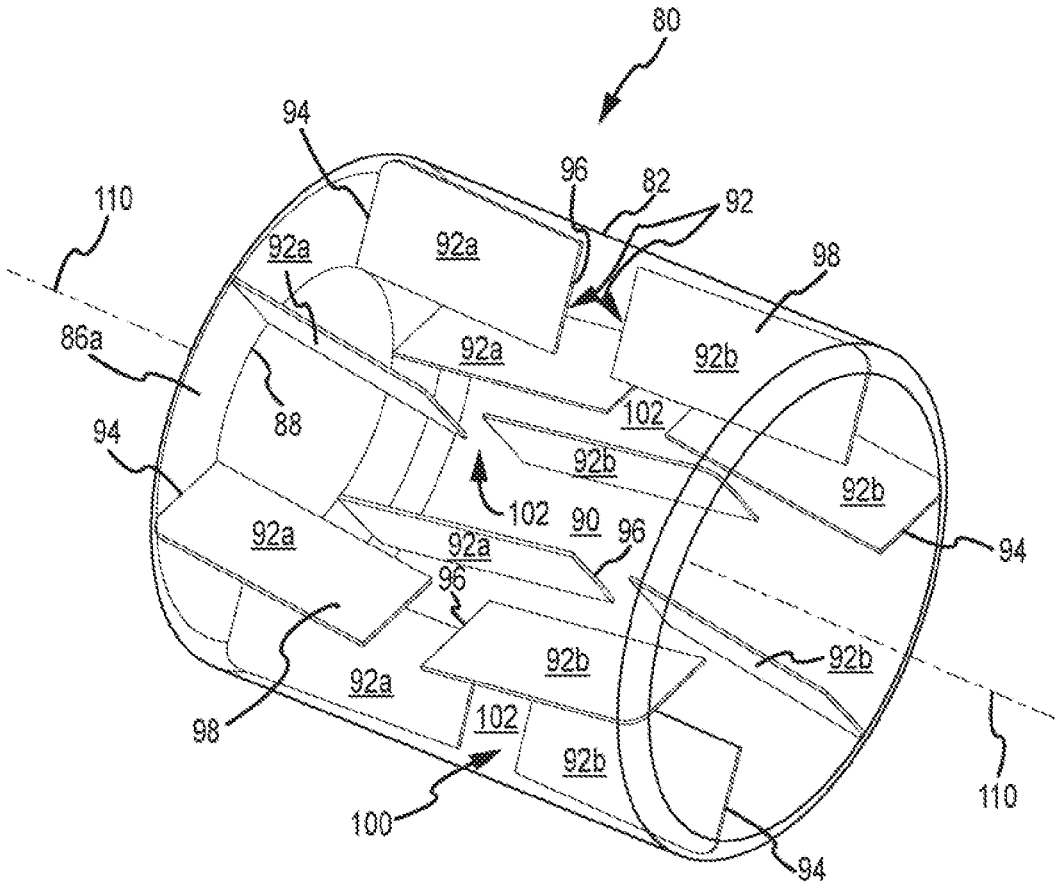
FIG. 4 is a perspective view of the tumbler from the horizontal mixer of FIG. 2, and with its various blades being shown in their entirety for clarity.
Figure 5A:
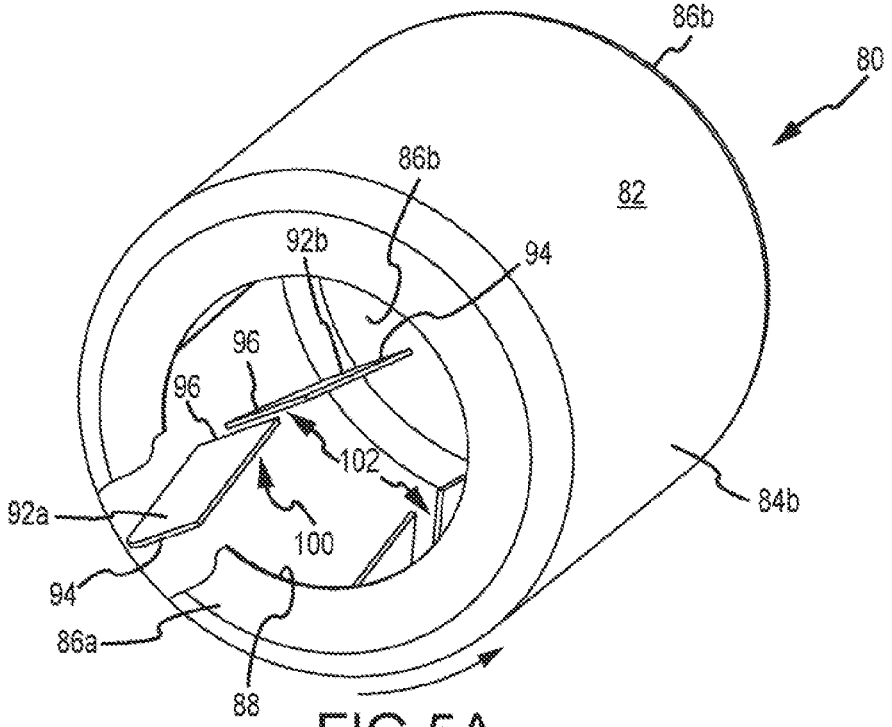
FIG. 5A is a perspective view of the interior of the tumbler of FIG. 4 and showing one of the blade pairs in about the 8 o'clock position.
Figure 5B:
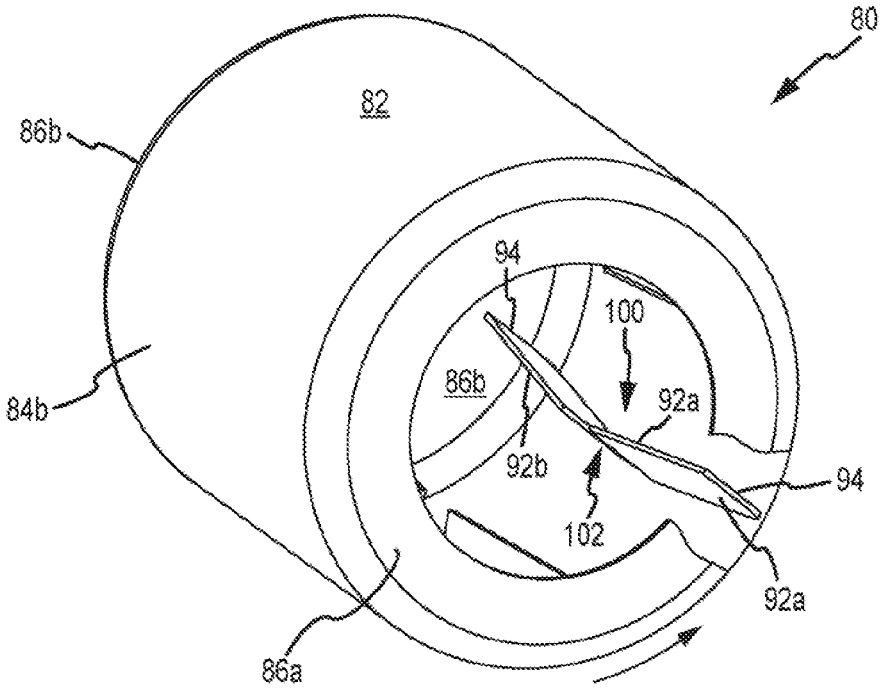
FIG. 5B is a perspective view of the interior of the tumbler of FIG. 4 and showing one of the blade pairs in about the 4 o'clock position.
Figure 6:
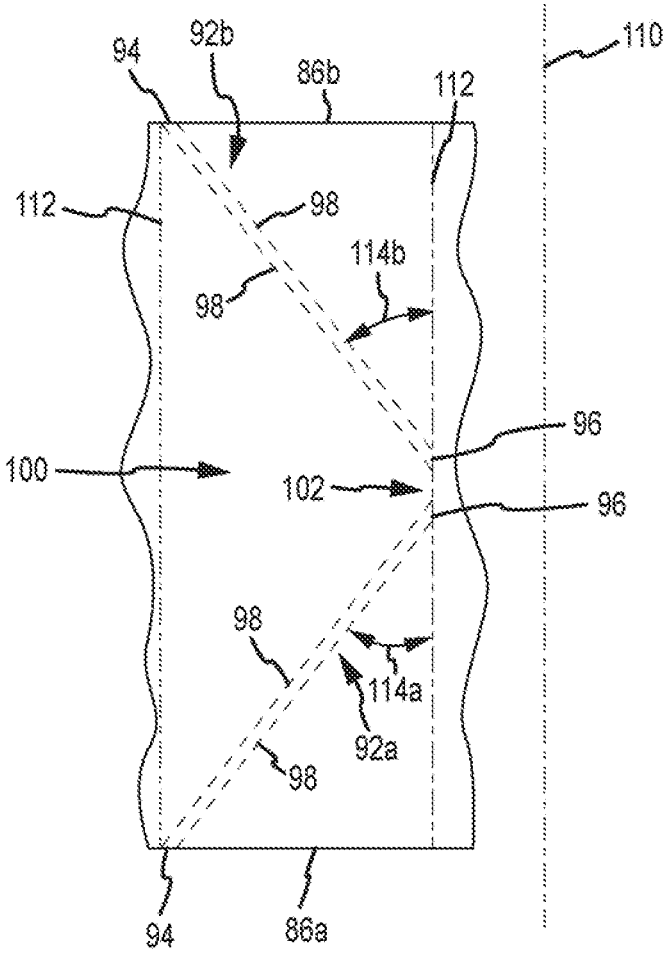
FIG. 6 is a plan view of part of the interior of the tumbler of FIG. 4, illustrating the orientation of one of its blade pairs.

The tumbler 80 of the horizontal mixer 50 is shown in each of FIGS. 2, 3, and 4. At least certain details regarding the blades 92 of the tumbler 80 are further shown in FIGS. 5A, 5B. Initially, it should be noted that the blades 92 extend from and rotate with the sidewall 82 of the tumbler 80 (specifically the interior surface 84*a* thereof). Any way of incorporating the blades 92 with the sidewall 82 of the tumbler 80 may be utilized (e.g., an integral or one-piece construction; having the blades 92 be separately attached or joined to the sidewall 82 and/or the corresponding tumbler end 86*a*, 86*b* in any appropriate manner). Generally, the blades 92 extend from the interior surface 84*a* of the sidewall 82 into the mixing chamber 90. This may be referred to as the "radial" direction or dimension. Although the blades 92 may extend orthogonally or perpendicularly from the interior surface 84*a* of the sidewall 82 (as shown in the illustrated embodiment), the blades 92 may extend from the interior surface 84*a* in other orientations.

The blades 92 of the tumbler 80 also extend along the interior surface 84 of the sidewall 82. This may be referred to as a longitudinal or length dimension. Each blade 92 includes a pair of primary surfaces 98 that are oppositely disposed. In the illustrated embodiment, these primary surfaces are flat or planar, although other contours/shapes may be appropriate.

There are basically two groups of blades 92 for the tumbler 80—a plurality of first blades 92*a* that extend at least generally from the first tumbler end 86*a*, and a plurality of second blades 92*b* that extend at least generally from the second tumbler end 86*b*. The outlet region 78 is located in the longitudinal dimension between the first blades 92*a* and the second blades 92*b*. As such, the plurality of first blades 92*a* may be characterized as being part of a first longitudinal segment of the tumbler 80, the outlet region 78 may be characterized as being part of a second longitudinal segment of the tumbler 80, and the plurality of second blades 92*b* may be characterized as being part of a third longitudinal segment of the tumbler 80. In the illustrated embodiment, these three longitudinal segments may be characterized as being disposed in non-overlapping relation. Another characterization may be that these three longitudinal segments are disposed in end-to-end relation and in the noted order, with the second longitudinal segment (including the outlet region 78) being located between the first longitudinal segment (including the first blades 92*a*) and the third longitudinal segment (including the second blades 92*b*) in the longitudinal dimension.

The output line 72 extends into the above-noted outlet region 78, which may be characterized as an intermediate longitudinal segment of the tumbler 80. In the illustrated embodiment, the output line 72 includes a first section 74*a* that extends at least primarily in the longitudinal dimension (e.g., at least generally parallel with the rotational axis 110), and a second section 74*b* that extends at least primarily in a downward direction. An end of the second section 74*b* includes an output/outlet port 76. The output port 76 is spaced from the interior surface 84*a* of the sidewall 82 for the tumbler 80. In one embodiment, the spacing between the output port 76 and the interior surface 84*a* is within a range of about 0.125 inches to about 0.135 inches. Generally, the output port 76 should be spaced a sufficient distance from the interior surface 84*a* of the sidewall 82 of the tumbler 80 so that the output port 76 does not become clogged. Spacing the output port 76 too far away from the interior surface 84*a* of the sidewall 82 of the tumbler 80 is also undesirable in that it will leave a large quantity of slurry within the tumbler 80.

Each blade 92 includes a first blade end 94 and a second blade end 96. The length of a given blade 92 corresponds with the spacing between its first blade end 94 and its second blade end 96. In the case of the first blades 92*a*, the first blade end 94 may be located on or adjacent to the first tumbler end 86*a* and the second blade end 96 may be spaced from the first tumbler end 86*a* (e.g., each first blade 92*a* may be characterized as extending from the first tumbler end 86*a* at least generally in the direction of the second tumbler end 86*b*, but terminating prior to reaching the second tumbler end 86*b*). Stated another way, the second blade end 96 of each first blade 92*a* may be located between the second tumbler end 86*b* and its corresponding first blade end 94 in the longitudinal dimension.

In the case of the second blades 92*b*, the first blade end 94 may be located on or adjacent to the second tumbler end 86*b* and the second blade end 96 may be spaced from the second tumbler end 86*b* (e.g., each second blade 92*b* may be characterized as extending from the second tumbler end 86*b* at least generally in the direction of the first tumbler end 86*a*, but terminating prior to reaching the first tumbler end 86*a*). Stated another way, the second blade end 96 of each second blade 92*b* may be located between the first tumbler end 86*a* and its corresponding first blade end 94 in the longitudinal dimension.

Each of the blades 92 may be characterized as being "center angled." Center angling of the various blades 92 may promote a desired mixing action within the mixing chamber 90 of the horizontal mixer 50. A number of characterizations may be made in relation to the orientation of each blade 92 relative to the rotational axis 110 of the tumbler 80, which may apply individually or in any combination. Consider the case where a plurality of reference axes 112 are on the sidewall 82 of the tumbler 80 and are parallel to the rotational axis 110 of the tumbler 80. The first blade end 94 may be on one such reference axis 112 and its corresponding second blade end 96 may be on a different reference axis (e.g., FIG. 6) for each of the various blades 92, and which may be used to promote a desired mixing action in the mixing chamber 90 of the tumbler 80.

Each blade 92 may be of the same height, where "height" is the distance that the blades 92 extend away from where the blades 92 intersect with the interior surface 84*a* of the tumbler 80. The height of each blade 92 may be constant along the entire length thereof. In one embodiment, the first blade end 94 of each blade 92 at its intersection with the interior surface 84*a* of the tumbler 80 is at a different elevation than its corresponding second blade end 94 at its intersection with the interior surface 84*a*, where the elevation is measured relative to a horizontal reference plane located below the tumbler 80. In one embodiment, the elevation continually changes at the intersection between each blade 92 and the interior surface 84*a* of the tumbler 80 proceeding from its first blade end 94 to its corresponding second blade end 96, again where the elevation is measured relative to a horizontal reference plane located below the tumbler 80.

The first blade end 94 may leads its corresponding second blade end 96 in a first rotational direction in the case of each blade 92, and which may be used to promote a desired mixing action in the mixing chamber 90 of the tumbler 80. In the view shown in FIGS. 5A and 5, the first rotational direction is counterclockwise. The arrow about the rotational axis 110 indicates the first rotational direction in each of FIGS. 2, 5A, 5B, and 7 (again, counterclockwise). Stated another way, the second blade end 96 may lag its corresponding first blade end 94 in a first rotational direction in the case of each blade 92.

Figure 7:
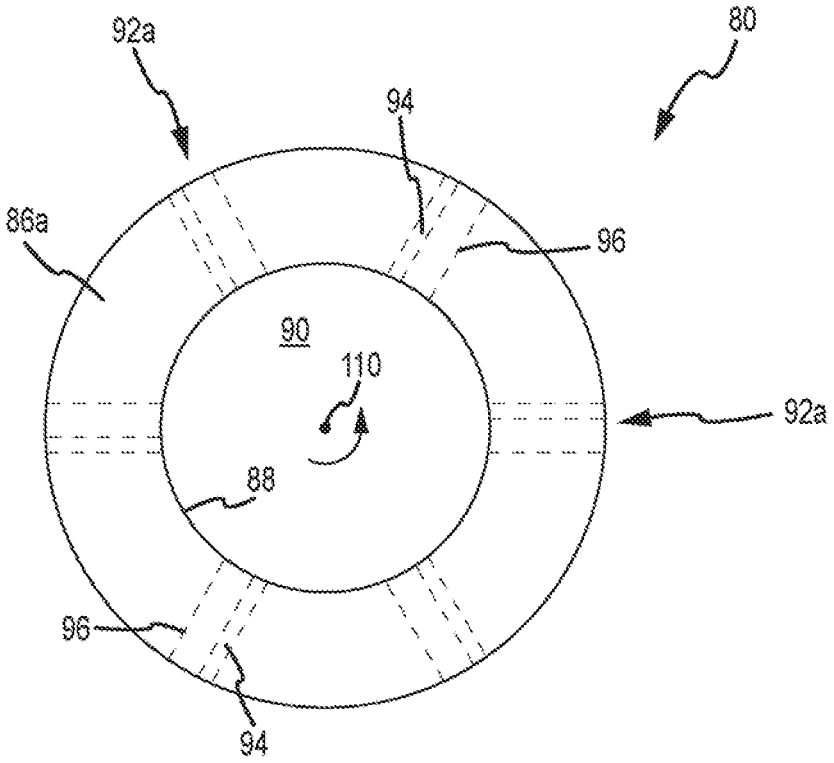
FIG. 7 is an end view of the tumbler of FIG. 4, illustrating the angular position and orientation of its plurality of first blades.

FIG. 7 further illustrates the above-noted leading/lagging relationship, with the arrow about the rotational axis 110 being the first rotational direction. In FIG. 7, the first blade end 94 of each first blade 92*a* is shown in dashed lines, as is an edge corresponding with each corresponding second blade end 96. During rotation of the tumbler 80 in the first rotational direction, the first blade end 94 of each first blade 92*a* will reach and pass the 6 o'clock position (such a "clock" being measured about the rotational axis 110) before its corresponding second blade end 96 reaches and passes the 6 o'clock position.

The various blades 92 for the mixer 50 are arranged so that there is a plurality of blade pairs 100 that are spaced about the rotational axis 110 (e.g., each blade pair being located at a different angular position relative to and measured about the rotational axis 110). Any number of blade pairs 100 may be utilized (6 blade pairs 100 in the illustrated embodiment). The blade pairs 100 are equally spaced about the rotational axis 100 in the illustrated embodiment, although other spacing arrangements could be utilized.

Each blade pair 100 includes one first blade 92*a* and one second blade 92*b*. In the illustrated embodiment, the first blade 92*a* and its corresponding second blade 92*b* (one first blade 92*a* and its corresponding second blade 92*b* defining a blade pair 100) are disposed in a mirror image relationship to each other. Referring back to FIG. 6, there is an included angle 114*a* between each first blade 92*a* and a reference axis 112 that is tangent to its second blade end 96 (again, where each reference axis 112 is parallel to the rotational axis 110), and there is an included angle 114*b* between each second blade 92*b* and a reference axis 112 that is tangent to its second blade end 96. In the illustrated embodiment, the magnitude of each included angle 114*a* is the same for all first blades 92*a*, the magnitude of each included angle 114*b* is the same for all second blades 92*b*, and the magnitudes of the included angles 114*a* and 114*b* are the same. This allows for the above-noted mirror image relationship. In one embodiment, each included angle 114*a*, 114*b* is within a range of about 3° to about 4°. The incline of the various blades 92*a*, 92*b* allows the output line 72, more specifically its output port 76, to be disposed in a "deeper reservoir" of slurry within the tumbler 80.

The various blade pairs 100 have an at least generally V-shaped profile. The second blade ends 96 of each blade pair 100 are separated by a gap 102 that coincides with the region 78 into which the output line 72 extends for withdrawing slurry from the mixer 50. The "V" of each blade pair 100 is oriented such that the noted gap 102 is the trailing portion of each blade pair 100 in the above-noted first rotational direction that is used for promoting a desired mixing action within the mixing chamber 90 during rotation of the tumbler 80 about its rotational axis 110 in the first rotational direction. Stated another way, the blade pairs 100 are orientated so each blade pair 100 is in the form of a concave structure in the first rotational direction (e.g., each blade pair 100 collectively defines an at least generally concave profile relative to the first rotational direction).

There are other alternatives in relation to the arrangement of the various first blades 92*a* and the various second blades 92*b*. The magnitude of the included angle 114*a* of each first blade 92*a* may be the same, the magnitude of the included angle 114*b* of each second blade 92*b* may be the same, but the magnitudes of the included angles 114*a* and included angles 114*b* may be different. It may be such that one or more different magnitudes are utilized for the included angle 114*a* of the various first blades 92*a* (e.g., one or more first blades 92*a* may be disposed at one common included angle 114*a*, while one or more other first blades 92*a* may be disposed at another common included angle 114*a*), that one or more different magnitudes are utilized for the included angle 114*b* of the various second blades 92*b* (e.g., one or more second blades 92*b* may be disposed at one common included angle 114*b*, while one or more other second blades 92*b* may be disposed at another common included angle 114*b*), or both.

Other arrangement of the first blades 92*a* relative to the second blades 92*b* may be utilized. For instance, the first blades 92*a* may be disposed about the rotational axis 110 in one pattern, and the second blades 92*b* may be disposed about the rotational axis 110 in a different pattern. The first blades 92*a* and second blades 92*b* may be disposed in staggered relation about the rotational axis 110. For instance, when the first blade end 94 of the first blades 92*a* are at the 2, 4, 6, 8, 10, and 12 o'clock positions in a first static position for the tumbler 80, the first blade end 94 of the second blades 92*b* may be at the 1, 3, 5, 7, 9, and 11 o'clock positions.

Figure 8:
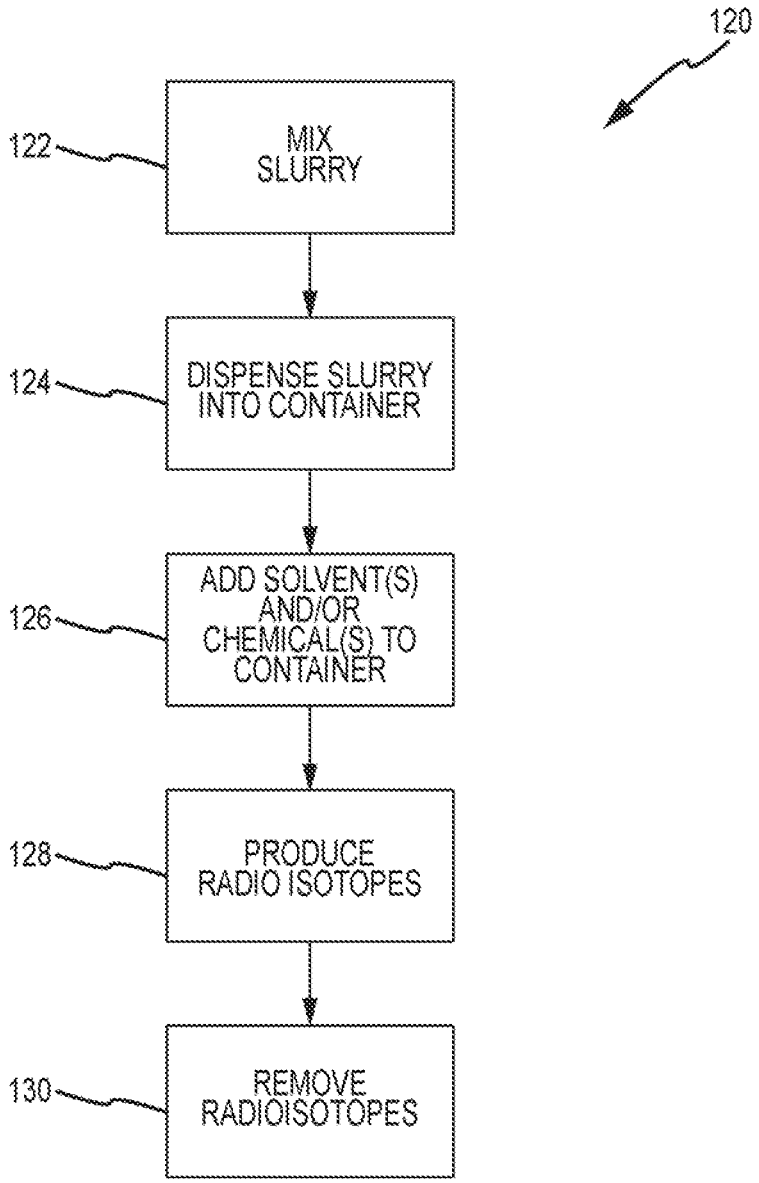
FIG. 8 is a schematic of one embodiment for producing radioisotopes.

The horizontal mixer 50 may be used in the fluid system 10 (in place of the horizontal mixer 20) to provide a slurry from which radioisotopes are produced. FIG. 8 illustrates one embodiment of such a production method 120. The radioisotope production method 120 includes mixing a slurry from which radioisotopes may be produced (step 122). The horizontal mixer 50 may be used to mix such a slurry, including when incorporated into the fluid system 10. In one embodiment, the slurry includes particles of alumina. Other particles that may be used by such a slurry include without limitation other chromatographic media for bonding or stripping. Other liquids that may be used for such a slurry include without limitation distilled water or media preparation solvents.

The slurry may be dispensed into an appropriate container (e.g. a glass column) pursuant to step 124 of the production method 120. This may entail using an appropriate dispensing apparatus, or it may be done by hand. Once the slurry is added to the column, the column may be loaded with a chemical or compound that adsorbs to the adsorbent materials that were part of the slurry (Step 126). In one embodiment, the column is utilized in a technetium generator wherein molybdenum-99 is added to the column, adsorbing onto the alumina column packing material. Over time, the molybdenum-99 decays to technetium-99m, a daughter radioisotope that is used in many nuclear medicine procedures (Step 128). While molybdenum-99 remains adsorbed to alumina, technetium-99m washes off of the alumina when water is passed through the column. Chromatographic separation of technetium-99m from molybdenum-99 may therefore occur by passing a water eluant through the column (Step 130). The technetium-99m is then isolated and utilized in medical applications such as medical diagnosis, medical treatment, and medical research.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed:

1. A horizontal mixer, comprising:

a container comprising a rotational axis that is at least substantially horizontally disposed, a first container end and a second container end that are spaced along said rotational axis, an inner sidewall disposed about said rotational axis and extending between said first container end and said second container ends, and a mixing chamber defined at least in part by said first container end, said second container end, and said inner sidewall;

a plurality of first blades and a plurality of second blades that each extend from said inner sidewall toward an interior of said mixing chamber and that each comprise a first blade end and a second blade end, wherein each said first blade extends from its corresponding said first blade end toward its corresponding said second blade end at least generally in a direction of said second container end, wherein each said second blade extends from its corresponding said first blade end toward its corresponding said second blade end at least generally in a direction of said first container end, and wherein said first blade end of each said plurality of first blades and said plurality of second blades leads its corresponding said second blade end in a first rotational direction for said container; and an outlet port from said mixing chamber of said container, wherein said plurality of first blades correspond with a first longitudinal segment of said horizontal mixer, wherein said plurality of second blades correspond with a second longitudinal segment of said horizontal mixer, wherein a third longitudinal segment of said horizontal mixer is located between said first longitudinal segment and said second longitudinal segment, wherein said first longitudinal segment, said second longitudinal segment, and said third longitudinal segment are non-overlapping in a direction extending along said rotational axis, wherein a longitudinal dimension coincides with said rotational axis, and wherein said outlet port is located within said third longitudinal segment at a lower elevation than said rotational axis, wherein said first longitudinal segment, said third longitudinal segment, and said second longitudinal segment are disposed in end-to-end relation.

2. The horizontal mixer of claim 1, wherein each said blade extends along said inner sidewall in an orientation relative to said rotational axis to direct container contents toward said outlet port during rotation of said container in said first rotational direction about said rotational axis.

3. The horizontal mixer of claim 1, wherein said first blade end of each of said plurality of first blades and said plurality of second blades is disposed on one longitudinal reference axis that is parallel to said rotational axis, and wherein its corresponding said second blade end is disposed on another longitudinal reference axis that is also parallel to said rotational axis.

4. The horizontal mixer of claim 1, wherein said first blade end of each said first blade is located at said first container end, and wherein said first blade end of each said second blade is located at said second container end.

5. The horizontal mixer of claim 1, wherein said horizontal mixer further comprises a plurality of blade pairs, wherein each said blade pair includes one said first blade and one said second blade.

6. The horizontal mixer of claim 5, wherein said first blade and said second blade of each said blade pair are orientated as a mirror image of each other.

7. The horizontal mixer of claim 5, wherein each said blade pair defines an at least generally V-shaped configuration.

8. The horizontal mixer of claim 5, wherein each said blade pair collectively defines a concave profile relative to said first rotational direction.

9. The horizontal mixer of claim 5, wherein a space between said second blade ends of said plurality of first blades and said plurality of second blades for each said blade pair is a trailing-most portion of said blade pair in said first rotational direction.

10. The horizontal mixer of claim 1, wherein said second blade end of each of said plurality of first blades and said plurality of second blades is spaced back from a midpoint between said first container end and said second container end in a direction of its corresponding said first blade end.

11. The horizontal mixer of claim 1, wherein only said plurality of first blades and said plurality of second blades extend from said inner sidewall.

12. The horizontal mixer of claim 1, further comprising an outlet conduit, wherein said outlet conduit comprises a first section and a second section, wherein said first section extends through said first container end and into said mixing chamber, wherein said second section extends downwardly from said first section and toward said inner sidewall within said third longitudinal segment, and wherein said second section of said outlet conduit comprises said outlet port.

13. The horizontal mixer of claim 12, wherein said outlet port is disposed on an end of said second section of said outlet conduit.

14. The horizontal mixer of claim 13, wherein a spacing between said outlet port and said inner sidewall is within a range of about 0.125 inches to about 0.135 inches.

15. The horizontal mixer of claim 1, wherein a spacing between said outlet port and said inner sidewall is within a range of about 0.125 inches to about 0.135 inches.

16. The horizontal mixer of claim 1, wherein said outlet port is disposed within said mixing chamber at least substantially mid-way between said first container end and said second container end.

17. The horizontal mixer of claim 1, wherein a radially inward-most portion of said first blade end and a radially inward-most portion of its corresponding said second blade end are disposed at different elevations from a horizontal reference plane for each of said plurality of first blades and said plurality of second blades.

18. The horizontal mixer of claim 1, wherein a length dimension of each said blade is disposed in non-parallel relation to said rotational axis.

19. The horizontal mixer of claim 1, wherein each of said plurality of first blades and each of said plurality of second blades are disposed at an angle relative to a corresponding reference axis that is parallel to said rotational axis, wherein each said angle is within a range of about 3° to about 4°.

20. The horizontal mixer of claim 1, wherein an elevation relative to a horizontal reference plane continually changes proceeding along a length dimension for each of said plurality of first blades and said plurality of second blades at an intersection with said inner sidewall.

21. A horizontal mixer, comprising:

a container comprising a rotational axis that is at least substantially horizontally disposed, a first container end and a second container end that are spaced along said rotational axis, an inner sidewall disposed about said rotational axis and extending between said first container end and said second container end, and a mixing chamber defined at least in part by said first container end, said second container end, and said inner sidewall;

a plurality of first blades and a plurality of second blades that each extend from said inner sidewall toward an interior of said mixing chamber and that each comprise a first blade end and a second blade end, wherein each said first blade extends from its corresponding said first blade end toward its corresponding said second blade end at least generally in a direction of said second container end, wherein each said second blade extends from its corresponding said first blade end toward its corresponding said second blade end at least generally in a direction of said first container end, and wherein said first blade end of each said plurality of first blades and said plurality of second blades leads its corresponding said second blade end in a first rotational direction for said container; and an outlet port from said mixing chamber of said container, wherein said plurality of first blades correspond with a first longitudinal segment of said horizontal mixer, wherein said plurality of second blades correspond with a second longitudinal segment of said horizontal mixer, wherein a third longitudinal segment of said horizontal mixer is located between said first longitudinal segment and said second longitudinal segment, wherein a longitudinal dimension coincides with said rotational axis, and wherein said outlet port is located within said third longitudinal segment at a lower elevation than said rotational axis;

wherein said first container end comprises an aperture, wherein said horizontal mixer further comprises an outlet conduit that extends through said aperture and to a location in said longitudinal dimension that is between said second ends of said plurality of first blades and said second ends of said plurality of second blades, and wherein said outlet conduit comprises said outlet port.

22. The horizontal mixer of claim 21, wherein a diameter of said aperture is substantially larger than an outer diameter of said outlet conduit.

23. The horizontal mixer of claim 21, wherein each said blade extends along said inner sidewall in an orientation relative to said rotational axis to direct container contents toward said outlet port during rotation of said container in said first rotational direction about said rotational axis.

24. The horizontal mixer of claim 21, wherein said first blade end of each of said plurality of first blades and said plurality of second blades is disposed on one longitudinal reference axis that is parallel to said rotational axis, and wherein its corresponding said second blade end is disposed on another longitudinal reference axis that is also parallel to said rotational axis.

25. The horizontal mixer of claim 21, wherein said horizontal mixer further comprises a plurality of blade pairs, wherein each said blade pair includes one said first blade and one said second blade, wherein said first blade and said second blade of each said blade pair are orientated as a mirror image of each other and with each said blade pair defining an at least generally V-shaped configuration.

26. The horizontal mixer of claim 21, wherein said second blade end of each of said plurality of first blades and said plurality of second blades is spaced back from a midpoint between said first container end and said second container end in a direction of its corresponding said first blade end.

27. The horizontal mixer of claim 21, wherein said first longitudinal segment, said third longitudinal segment, and said second longitudinal segment are disposed in end-to-end relation.

28. The horizontal mixer of claim 21, wherein said outlet conduit comprises a first section and a second section, wherein said first section extends through said first container end and into said mixing chamber, wherein said second section extends downwardly from said first section and toward said inner sidewall within said third longitudinal segment, and wherein said second section of said outlet conduit comprises said outlet port.

29. The horizontal mixer of claim 28, wherein said outlet port is disposed on an end of said second section of said outlet conduit.

30. The horizontal mixer of claim 29, wherein a spacing between said outlet port and said inner sidewall is within a range of about 0.125 inches to about 0.135 inches.

31. The horizontal mixer of claim 21, wherein said outlet port is disposed within said mixing chamber at least substantially mid-way between said first container end and said second container end.

32. The horizontal mixer of claim 21, wherein a radially inward-most portion of said first blade end and a radially inward-most portion of its corresponding said second blade end are disposed at different elevations from a horizontal reference plane for each of said plurality of first blades and said plurality of second blades.

33. The horizontal mixer of claim 21, wherein a length dimension of each said blade is disposed in non-parallel relation to said rotational axis.

34. The horizontal mixer of claim 21, wherein each of said plurality of first blades and each of said plurality of second blades are disposed at an angle relative to a corresponding reference axis that is parallel to said rotational axis, wherein each said angle is within a range of about 3° to about 4°.

35. The horizontal mixer of claim 21, wherein an elevation relative to a horizontal reference plane continually changes proceeding along a length dimension for each of said plurality of first blades and said plurality of second blades at an intersection with said inner sidewall.

* * * * *